United States Patent [19]

Kiess et al.

[11] Patent Number: 4,508,092

[45] **Date of Patent: * Apr. 2, 1985**

[54] MAGNETIC SENSOR FOR DISTRIBUTORLESS IGNITION SYSTEM AND POSITION SENSING

[75] Inventors: Ronald J. Kiess, Decatur; Gary R. Nichols, Woodburn, both of Ind.

[73] Assignee: Magnavox Government and Industrial Electronics Company, Fort Wayne, Ind.

[ * ] Notice: The portion of the term of this patent subsequent to Sep. 27, 2000 has been disclaimed.

[21] Appl. No.: 492,947

[22] Filed: May 16, 1983

Related U.S. Application Data

[63] Continuation of Ser. No. 223,778, Jan. 9, 1981, Pat. No. 4,406,272, which is a continuation-in-part of Ser. No. 105,697, Dec. 20, 1979, abandoned.

[51] Int. Cl.[3] ..... F02P 3/06; F02P 1/00; F02P 3/02; G08B 21/00

[52] U.S. Cl. ..... 123/617; 123/613; 123/146.5 A; 324/208

[58] Field of Search ..... 123/617, 146.5 A, 613; 324/208; 310/168

[56] References Cited

U.S. PATENT DOCUMENTS

| | | | |
|---|---|---|---|
| 3,073,879 | 1/1963 | Straub | 123/617 |
| 3,139,876 | 6/1964 | Jukes | 123/617 |
| 3,291,109 | 12/1966 | Neapolatakis | 123/617 |
| 3,366,909 | 1/1968 | Hini et al. | 338/32 |
| 3,518,978 | 7/1970 | Schmiedel | 123/617 |
| 3,621,826 | 11/1971 | Chrestensen | 123/613 |
| 3,792,261 | 2/1974 | Canup et al. | 123/613 |
| 3,807,378 | 4/1974 | Werner, Jr. | 123/613 |
| 3,875,920 | 4/1975 | Williams | 123/148 E |
| 3,921,610 | 11/1975 | Hartig | 123/117 R |
| 3,923,022 | 12/1975 | Scholl | 123/117 R |
| 3,931,804 | 1/1976 | Bowen | 123/613 |
| 3,976,044 | 8/1976 | Madeira et al. | 123/613 |
| 4,086,533 | 4/1978 | Ricouard et al. | 324/208 |
| 4,109,630 | 8/1978 | Richeson, Jr. et al. | 123/148 E |
| 4,155,341 | 5/1979 | Fernquist et al. | 123/148 CC |
| 4,165,726 | 8/1979 | Helmer, Jr. | 123/146.5 A |
| 4,204,158 | 5/1980 | Ricouard et al. | 324/208 |
| 4,235,213 | 11/1980 | Jellissen | 123/146.5 A |
| 4,237,844 | 12/1980 | Lathlaen | 123/617 |
| 4,290,044 | 9/1981 | Ishikawa et al. | 340/52 |

*Primary Examiner*—Raymond A. Nelli

*Attorney, Agent, or Firm*—Thomas A. Briody; William J. Streeter; Richard T. Seeger

[57] ABSTRACT

A magnetic sensor for a distributorless ignition system is useable in an internal combustion engine. A Hall-effect device is spaced intermediate a pair of opposing permanent magnets for concurrently generating dual magnetic flux fields within respective air gap regions formed between each of the magnets and the device. Alternatively a magnet is placed between two Hall-effect devices to define the regions. A toothed disk rotatably connected to the crank-shaft of the engine causes different teeth to shunt the fields in each of the regions in a predetermined sequence for generating pulses at the device output indicative of the firing order of the engine. Alternatively, a disk having outer and inner notched rims is used to shunt the fields in each of the regions. Further, an elongated channel shaped member has sides movable in the regions for detecting relative linear motion between two parts.

11 Claims, 17 Drawing Figures

MAGNETIC SENSOR FOR DISTRIBUTORLESS IGNITION SYSTEM AND POSITION SENSING

RELATED APPLICATIONS

This is a continuation of our copending application Ser. No. 223,778 filed Jan. 9, 1981, now U.S. Pat. No. 4,406,272, and entitled "Magnetic Sensor for Distributorless Ignition System and Position Sensing" which is a continuation-in-part of our copending application Ser. No. 105,697, filed Dec. 20, 1979, entitled "Magnetic Sensor for Distributorless Ignition System," now abandoned.

BACKGROUND OF THE INVENTION

This invention relates generally to a distributorless and contactless ignition system useable in an internal combustion engine and particularly to a magnetic sensor employing a Hall-effect device operatively connected to an engine crankshaft to enable sensing the rotative position thereof.

Ignition systems for modern internal combustion engines often employ a contactless distributor circuit which produces a predetermined series of output pulses suitable for firing the spark plugs of the engine in a predetermined firing order sequence. In such circuits passive sensors such as variable reluctance magnetic elements are positioned within the distributor to threshhold detect or zero crossing detect a waveform generated by a passing lobe, notch or tooth formed of appropriate material and which is connected to the rotatable distributor shaft. Distributorless ignition systems are also known in the prior art wherein a large plurality of magnetic responsive elements produce unidirectional pulses from magnetic fields. Typically, two or more magnetic sensor elements are utilized in applications wherein a first sensor provides a reference pulse and a second sensor generates a large plurality of other related timing pulses. Alternatively, each of two pickups or transmitters used in conjunction with a disc having a large plurality of teeth or gaps are applied, respectively, to differing encoding elements utilizing four stage binary counting to produce the requisite firing order signals. Such ignition systems, when utilizing the distributor concept, incur the inherent additional weight, radio frequency interference, mechanical complexities, and propensity for misadjustment and tampering involved with the incorporation of a distributor in the ignition system. In distributorless systems, in addition to the above reasons, the plural magnetic sensors increase system costs and complexity.

SUMMARY OF THE INVENTION

Accordingly, it is an object of the present invention to provide a sensing device responsive to the angular position of a rotating engine shaft such as a crankshaft or camshaft and which generates a sequence of output pulses indicative of the engine firing order without the use of a distributor. Another object is to provide a contactless ignition system. Yet another object of the present invention is to provide a magnetic sensor for a distributorless ignition system which utilizes a single Hall-effect device concurrently responsive to dual opposing magnetic fields. Another object is to provide two Hall-effect sensors spaced on either side of a magnet and to provide magnetic field shunting members which pass through the spaces between the magnet and the sensors as the shaft is rotating to provide a two digit binary output to indicate predetermined shaft rotational positions. Still another object is to provide a magnetic sensor for use in a distributorless ignition system which resists tampering and minimizes radio frequency interference (RFI). A further object is to provide a sensor for detecting linear position and movement between reciprocating members.

Briefly, these and other objects are accomplished in one embodiment by a single Hall-effect device which is spaced equidistantly and intermediately of a pair of opposing permanent magnets for concurrently sensing variations in dual magnetic flux fields generated within respective radially spaced air gap regions formed between each of the magnets and the device. A toothed disk having radially spaced teeth is connected to a rotatable shaft of the engine and causes teeth of differing radial position to rotate through each of the air gap regions in a predetermined sequence for generating pulses at the device output indicative of the firing order sequence of the engine cylinders. In a second embodiment, a magnet is placed between and radially spaced from two Hall-effect sensors and a disk having an outer rim and a radially spaced inner rim, with notches formed in each rim is rotated by the shaft, with a rim passing between the magnet and the sensors, periodically shunting the magnetic field between the magnet and the sensors. The output pulses are transmitted to a microprocessor which advances or delays the timing of the pulses in accordance with engine speed and which provides output pulses to coil driving circuits and spark coils for firing of the respective cylinders. In another embodiment, a linear channel shaped member has notched sides movable, respectively, between a magnet and Hall-effect sensor combination, for detecting motion and position relative the channel.

For a better understanding of these and other aspects of the invention, references may be made to the following detailed description taken in conjunction with the accompanying drawings.

DESCRIPTION OF THE PREFERRED EMBODIMENT

Figure 1:
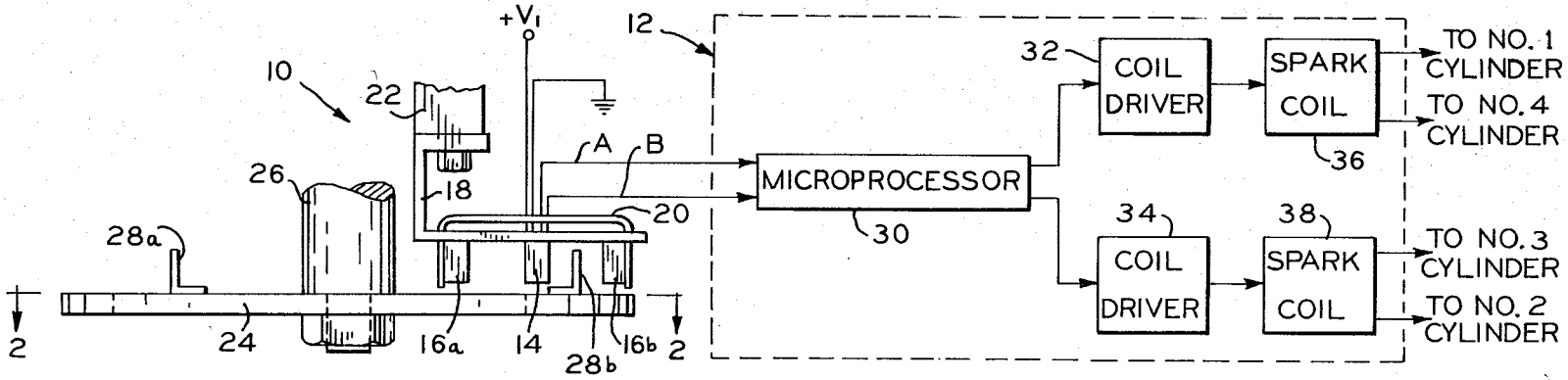
FIG. 1 is a top plan view and block diagram, respectively, of the magnetic sensor apparatus and associated electronic circuitry for an ignition system made according to the present invention.

In FIG. 1 there is illustrated a magnetic sensor 10 connected to a spark generating circuit 12. Within the magnetic sensor 10 there is positioned a Hall-effect device 14 spaced equidistant between a pair of opposing permanent magnets 16*a*, 16*b*. The Hall-effect device 14 and the magnets 16*a*, 16*b* are all commonly positioned in a linear arrangement on one surface of a support member 18. The magnets 16*a*, 16*b* are further supported on the member 18 by means of "C" shaped support element 20 which extends in back of and through the support member 18 so as to provide extension elements adjacent each of the magnets 16*a*, 16*b* to provide support and bonding thereto. The assembly comprising the Hall-effect device 14, magnets 16*a*, 16*b* and support element 20, as positioned on the support member 18, is stationary and connected to an appropriate place on the engine block 22. A moveable shunt member 24 shown as a rotatable toothed disk is connected to a rotatable shaft 26 such as a crankshaft or a camshaft. Positioned on the movable member 24 are a pair of teeth 28*a*, 28*b*, formed of ferrous material. The tooth 28*a* is positioned on the member 24 so that as the member 24 rotates in accordance with the movement of the shaft 26, tooth 28*a* is caused to pass in the region between magnet 16*a* and the Hall-effect device 14. Similarly, tooth 28*b* is positioned on the movable member 24 so as to pass in the region between the magnet 16*b* and the other side of the Hall-effect device 14.

The device 14 provides a pair of output lines to the inputs of a microprocessor 30 contained within the spark generating circuit 12. The microprocessor 30 provides a pair of output lines, one of which is connected to the input of a coil driver 32 which provides an output to a spark coil 36 whose outputs are adapted to be connected to the spark plugs of cylinders number 1 and 4 of a four cylinder internal combustion engine (not shown). Similarly, the other output of the microprocessor 30 is connected to the input of a coil driver 34 whose output is connected to a spark coil 38 which provides output signals to the spark plugs of cylinders number 3 and 2 of the engine.

Figure 2:
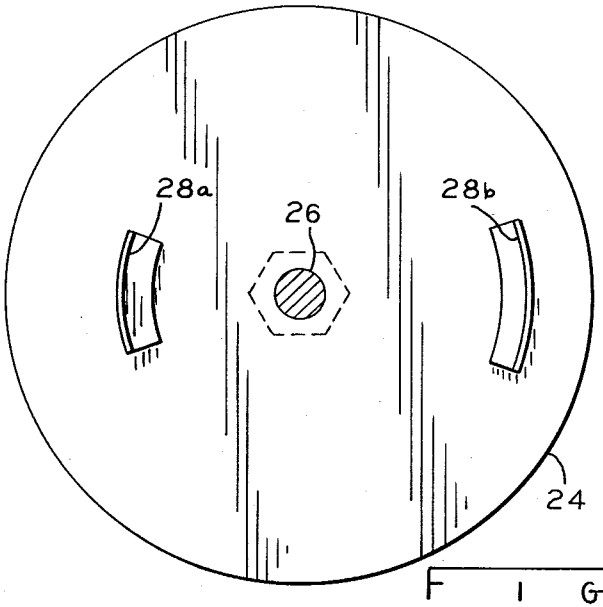
FIG. 2 is a front elevation view taken along the line 2—2 of FIG. 1 of the toothed shunt disk of the sensor apparatus of the invention.

Referring now to FIG. 2 there is shown a front elevation view of the movable member 24 taken along the lines 2—2 noted in FIG. 1. As now can be more clearly seen the member 24 is in the form of a ferrous disk having the teeth 28*a*, 28*b* positioned thereon at distinctively different radii so as to insure passage of the tooth 28*a* intermediate device 14 and magnet 16*a* and passage of the tooth 28*b* intermediate device 14 and magnet 16*b*.

Figure 3:
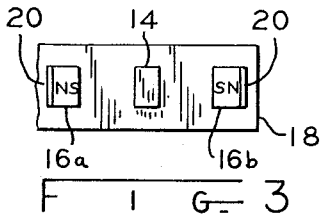
FIG. 3 is a front elevation view of a portion of the magnetic field generating and sensing elements of the sensor apparatus according to the present invention.

Referring now to FIG. 3, there is shown an elevation view of a portion of the support member 18 and the associated Hall-effect device 14, the magnets 16*a*, 16*b*, and the extended portions of the support element 20. More clearly shown are the polarizations of the magnets 16*a*, 16*b*, and by way of example, the magnets are shown with the south poles thereof facing opposite parallel sufaces of the device 14 in opposing fashion. Alternatively, the magnets 16*a* and 16*b* may also be positioned so that the north poles thereof face the opposing surfaces of the device 14.

Figure 4:
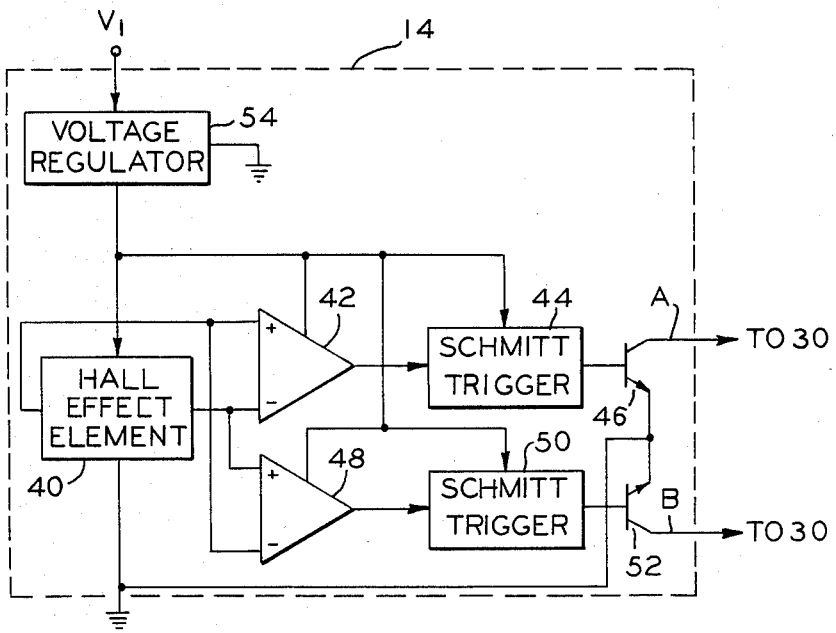
FIG. 4 is a schematic block diagram of the Hall-effect device used in the sensor of the present invention.

FIG. 4 illustrates a schematic block diagram of the circuitry associated with the Hall-effect device 14. Such circuitry, though shown as discrete elements within the diagram, most preferrably are combined in the preferred embodiment in a single monolithic integrated circuit chip inclusive of all the elements shown within the dotted lines of the figure. As an integrated embodiment the Hall-effect device 14 is essentially a four lead device having an input voltage $V_1$ connection, a ground connection, and two output signal leads for carrying output signals which will be described in further detail hereinafter. The device 14 includes a Hall-effect element 40 having a pair of output lines connected to the differential inputs of a first differential amplifier 42. The output of amplifier 42 is connected to the input of a first Schmitt trigger 44 which drives the base of a first output transistor 46 whose collector forms one of the output signal leads of the device 14. Similarly, and connected in common with the output leads of the Hall-effect element 40 but in reverse polarity, are the inputs of a second differential amplifier 48 whose output is connected to a second Schmitt trigger 50 which drives the base of second output transistor 52 whose collector forms the second output signal lead of the device 14.

Figure 5:
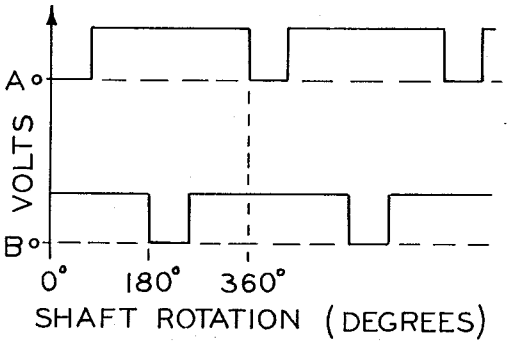
FIG. 5 is a graph of output waveforms generated by the Hall-effect device of FIG. 4.

FIG. 5 is a timing diagram of waveforms of output signals A and B produced, respectively, at the collector output leads of output transistors 46, 52 within the device 14. The timing diagram is representative of the firing order sequence required in a four cylinder internal combustion engine having a waste spark ignition system.

Figure 6:
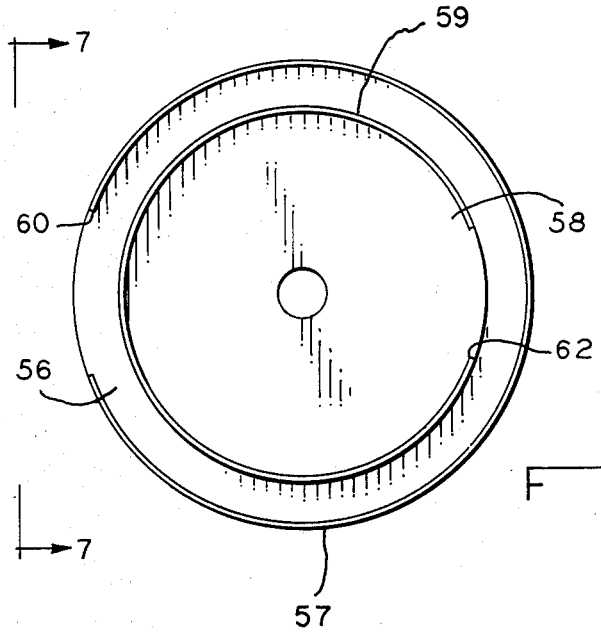
FIG. 6 is a front elevation view of an alternate form shunt disk according to the present invention.

FIG. 6 is a front elevation view of an alternate form of the movable member 24 shown in FIGS. 1 and 2. In contrast to the toothed disk form, the movable member shown in FIG. 6 is an assembly of interconnected circular ferrous disks 56 and 58, each having substantially orthogonal ferrous sidewalls or rims 57, 59, respectively, formed around the periphery thereof in coaxial relationship with the other. The coaxially aligned sidewalls of the disks 56, 58 each have a notch formed therein with a notch 60 formed in the sidewall 57 of disk 56 and a notch 62 formed in the sidewall 59 of disk 58.

Figure 7:
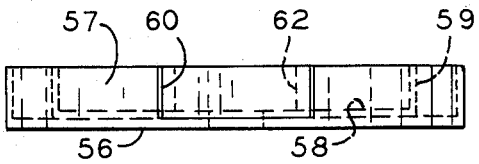
FIG. 7 is a side elevation view of the shunt disk taken along the line 7—7 shown in FIG. 6.

Referring now to FIG. 7 there is shown a side elevational view taken along the line 7—7 shown in FIG. 6. More clearly shown is a portion of the sidewall 57 of the disk 56 with associated notch 60 formed therein. Since, in this example, the notches are not aligned with one another, a portion of the sidewall 59 of disk 58 is viewed through the notch 60.

Operation of the magnetic sensor as used within the distributorless ignition system will now be discussed with reference to FIGS. 1 through 5. Referring again to FIG. 1, it will be seen that as the movable member 24 rotates with the shaft 26, it causes the teeth 28*a* and 28*b* to pass, respectively, and at predetermined times in the regions between the magnet 16*a* and the Hall-effect device 14 and between the magnet 16*b* and the device 14. When either the inner tooth 28*a* or outer tooth 28*b* of the movable member 24 passes between the respective magnet and the Hall-effect device, the field generated by that magnet is shunted and the opposing magnetic field overbalances the Hall-effect device and causes a pulse output to be generated on one of the respective output lines as noted in waveforms A and B of FIG. 5. The Hall-effect element 40 noted in FIG. 4 when shunted from the effects of a corresponding magnet 16*a*, 16*b*, by one or the other of the ferrous teeth 28*a*, 28*b*, provides a differential output signal to the inputs of the differential amplifiers 42, 48. Amplifier 42, in the preferred embodiment, is connected to the element 40 such as to process positive flux changes experienced by the Hall-effect element 40 and which changes are converted by the amplifier 42 into a positive polarity output signal which is transmitted to the input of the Schmitt trigger 44 for pulse shaping and squaring purposes. The shaped positive output pulse from trigger 44 is connected to one input of the microprocessor 30 by means of the output transistor 46. Similarly, differential amplifier 48 responds to negative flux changes experienced by the element 40 and converts the negative flux output signal from the element into a positive going output pulse which is shaped by Schmitt trigger 50 and transmitted to another input of the microprocessor 30 by means of driving transistor 52. In this manner, a single Hall-effect element concurrently responds to the passage of each of the ferrous teeth 28*a*, 28*b* positioned in the movable member 24 and differentiates between the teeth as exhibited by either a positive or negative flux change in the field generated by the magnets and varied by the passage of the teeth through such fields.

The width of the respective pulses generated at the outputs A and B of the Hall-effect device 14 is predetermined by adjusting the respective lengths of the teeth, thus controlling the period of time over which the respective flux field is shunted. The main criteria for determination of pulse width is related to the desired dwell time in the ignition system including time required for retard or advance of the firing signal. In the preferred embodiment, a pulse width of approximately 40° arc angle from the center of the movable member 24 was found to be most effective.

In the preferred embodiment, the magnetic sensor and associated circuitry are configured for operation with the crankshaft of a four cylinder internal combustion engine. In this case and since there are only two pairs of cylinders, only two pulses are needed to be generated 180° out of phase with respect to each other. Accordingly, the pulse generation is implemented by affixing two teeth 28*a*, 28*b* on the surface of the movable member 24 in diametrically opposite positions 180° out of shaft angle position with each other. As the crankshaft rotates, the teeth 28*a* and 28*b* will cause respective signals to be generated by the Hall-effect element 40 in a 180° timing relationship and which signals are later processed and shaped by the differential amplifiers 42, 48 and Schmitt triggers 44, 50 to provide output pulses from driving transistors 46, 52 to produce output waveform signals as shown in FIG. 5.

Although shown in the preferred embodiment as a circular disk, it will be obvious to those skilled in the art that the member 24 may be fashioned in any convenient form such as a simple flat extension designed to support the teeth 28*a*, 28*b* and to cause the teeth to pass through the respective magnetic field regions.

FIG. 5 illustrates typical waveform output signals A, B formed at the collector outputs of transistors 46, 52. The waveforms each illustrate a series of pulses wherein each waveform generates a pulse series having a 180° shaft angle rotation difference with respect to the other. The negative-going edge of the pulses indicates the turn-on time for the associated spark coil and the positive-going edge indicates the firing time of the cylinder. In waveform A and at 0° shaft angle rotation, the negative-going pulse edge indicates the energization of spark coil 36. At the next succeeding positive edge of the pulse (approximately 40° shaft rotation later), spark coil 36 simultaneously provides firing signals to cylinders 1 and 4. Similarly, and noting waveform B, pulses are generated 180° shaft angle rotation later and spark coil 38 simultaneously turns on and fires cylinders 3 and 2.

The preferred embodiment illustrated in FIG. 1 illustrates the concurrent generation and transmission of firing signals to cylinder numbers 1 and 4 or to cylinder numbers 3 and 2. The high voltage ignition output pulse from each of the spark coils 36, 38 is supplied to a preselected and respective pair of cylinders such that each cylinder of a given pair simultaneously receives high voltage ignition pulses and each different pair of cylinders alternately receives high voltage ignition pulses at 180° intervals. This type of ignition circuitry is generally known as a waste spark ignition system. Ignition timing and selection of cylinder pairs are such that for a given pair of cylinders, an ignition pulse is supplied when, for example, one cylinder of a given pair is at the end of its compression stroke while the other cylinder of the pair is at the end of its exhaust stroke. Thus, in a four cylinder engine whose firing order sequence is 1-3-4-2, a first pair of cylinders 1 and 4 are simultaneously supplied with the high voltage ignition pulse (firing 1) and at 180° angle of shaft rotation later, a second pair of cylinders 3 and 2 is so supplied (firing 3). The timing and high voltage pulse generation process continues firing in sequence the remaining cylinders 4 and 2.

FIGS. 6 and 7 note an alternate embodiment of the toothed disk shown in FIGS. 1 and 2. The same sensing effects experienced by the Hall-effect element 40 when working in conjunction with a toothed movable shunt member 24 can be duplicated by the notched disks 56, 58 shown in FIGS. 6 and 7. Disk 56 has circular rim 57 with arcuate notch 60 and disk 58 has coaxial circular rim 59 with arcuate notch 62, displaced 180° from notch 60. In this implementation, however, the circuitry of FIG. 4 will operate so as to note the presence of the non-shunting notches 60, 62 when the respective moveable members are in a rotational position so that the notches are in their respective air gap regions, thereby creating an imbalance in the opposing magnetic flux fields.

Figure 8:
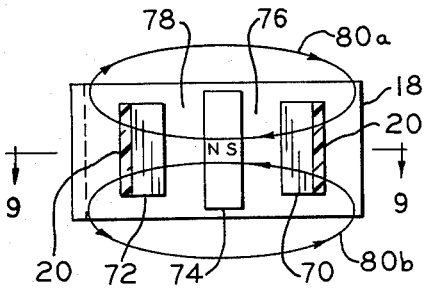
FIG. 8 is a view of an embodiment having two Hall-effect devices and a magnet placed therebetween.
Figure 9:
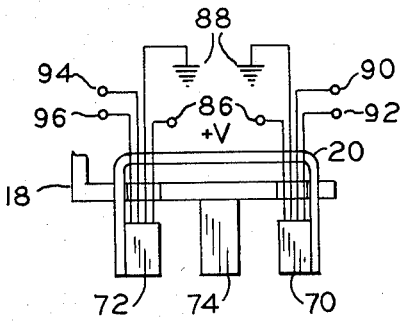
FIG. 9 is a section taken along line 9—9 of FIG. 8.

Referring to FIGS. 8 and 9, in a further embodiment, two Hall-effect sensors and one magnet are utilized. Hall-effect sensors 70, 72 are radially spaced on the aforementioned non-magnetic bracket 18 and supported there against by the aforementioned C-shaped non-magnetic support element 20, which is mounted in the manner and as shown in FIG. 1. Permanent magnet 74 is supported on bracket 18, as by cementing or other suitable means, between sensors 70, 72, with radial regions or gaps 76, 78 being between magnet 74 and sensors 70, 72 respectively. A magnetic field having flux paths 80*a*, 80*b* shown diagrammatically, permeates regions 76, 78 and sensors 70, 72.

Referring to FIG. 9, sensors 70, 72 each have leads connected to a voltage supply terminal 86 and to ground 88. Sensor 70 has output leads 90, 92 and sensor 72 has output leads 94, 96. Sensor devices having three leads for voltage supply, ground, and output may be utilized, such as manufactured by Sprague Electric Company, part no. UGS-3020T. The output across leads 90, 92 corresponds to the output on lead A for the embodiment of FIGS. 1–5 and the output across 94, 96 corresponds to the output on lead B of that embodiment. Leads 90, 92, 94, and 96 may be connected directly to processing circuitry 12, after suitable shaping, as by Schmitt trigger circuits, which can be performed by integrated circuitry packaged with the Hall-effect sensor 70, 72, or to the circuitry disclosed in copending application incorporated herein by reference entitled "Rotational Position and Velocity Sensing Apparatus" Ser. No. 223,779, filed Jan. 9, 1981 by Gary R. Nichols and John J. Kozlowski, Jr. now U.S. Pat. No. 4,373,486. As will become apparent, when the field in space 76 is shunted, the output of sensor 70 will change and when the field in space 78 is shunted, the output of sensor 72 will change. The embodiment of FIGS. 8, 9 may be used with disk 24 or disks 56, 58, and will be next described in connection with disk 24.

Referring to FIGS. 2, 5 and 9, tooth **28*a* is radially positioned from the axis 27 of shaft 26 a distance equal to the radial location of gap 78 and passes freely through gap 78 upon rotation of shaft 26. Tooth 28*b* is radially positioned from axis 27 a distance equal to the radial location of gap 76 and similarly passes through gap 76 upon rotation of shaft 26. As tooth 28*a* passes through gap 78, the output of sensor 72 is changed from a high level, or binary "1", to a low level, or binary "0", as shown by waveform A in FIG. 5. As tooth 28*b* passes through gap 76, the output of sensor 70 changes from a high level or binary "1", to a low level, or binary "0", as shown in waveform B of FIG. 5. Thus, every 360° of shaft 26 rotation, a "0" pulse is provided to processor 12 on lead A and, at a 180° phase difference, a "0" pulse is provided to processor 12 on lead B every 360° rotation of shaft 26. Differential amplifiers 46, 48** in this embodiment are unnecessary to provide the desired pulse direction.

Disks 56, 58 may also be used with the embodiment of FIGS. 8 and 9 and operate in a similar manner with the exception that the sensors 70, 72 have their outputs shunted when rims 57, 59 are in gaps 76, 78, respectively, and therefore would have a low, or binary "0", output. When notches 60, 62 are in gaps 76, 78 the outputs of sensors 70, 72 will be high, or binary "1". The waveforms of FIG. 5 may be obtained by inverting the sensor 70, 72 outputs in any manner known to the art. For example, in the aforementioned Sprague sensor, monolithic circuitry is available in the sensor package which inverts the outputs. Further, the waveforms of FIG. 5 may be inverted to meet the requirements of a particular microprocessor 30 to provide the desired coil drives.

Figure 10:
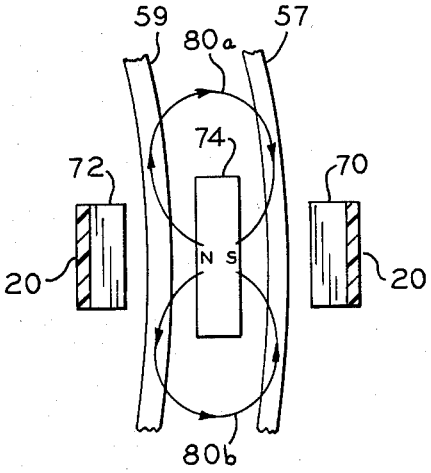
FIG. 10 is a section similar to FIG. 9 with shunting rims between each sensor and the magnet.

By modifying the notch placements in the rims 57, 59 four two digit binary outputs 0,0; 0,1; 1,0; and 1,1 may be obtained. In FIGS. 10–13, notches 60, 62 are positioned in rims 57, 59, respectively, to achieve the indicated and desired outputs. In FIG. 10 the field between sensors 70, 72 and magnet 74 is shunted by rims 57, 59, respectively, and flux paths **80*a*, 80*b* are shunted and pass through rims 57, 59, and disks 56, 58, respectively, for a first rotative position of the shaft. Thus no flux passes through sensors 70, 72 and their respective outputs are low, or a binary "0". As previously mentioned, the high outputs under the no-flux condition in the sensors may be achieved in the FIGS. 10–13** examples by inverting the sensor outputs, or by conventional circuit methods known to the art.

Figure 11:
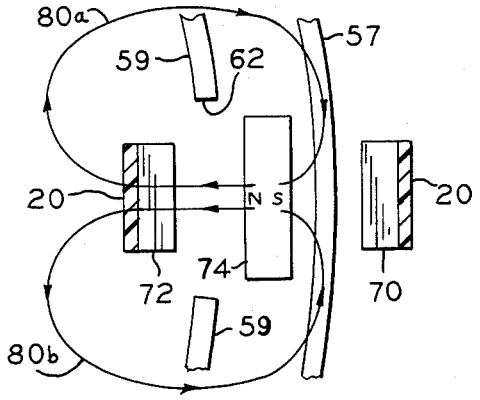
FIG. 11 is a section similar to FIG. 9 with a shunting rim between one sensor and a magnet.

In FIG. 11, for a second rotative position of the shaft 26, the field between magnet 74 and sensor 70 is shunted by rim 57 while the field between magnet 74 and sensor 72 is not shunted, since notch 62 is positioned therebetween. The binary output of sensors 70, 72 for this second rotative position of the shaft is "0,1".

Figure 12:
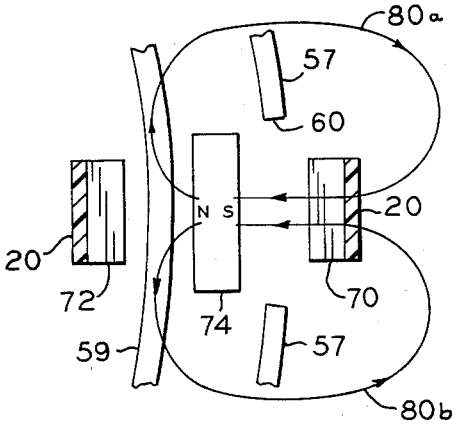
FIG. 12 is a section similar to FIG. 9 with a shunting rim between the other sensor and the magnet.

In FIG. 12, a third rotative position of the shaft positions notch 60 between magnet 74 and sensor 70 allowing paths **80*a* and 80*b* to pass through sensor 70, while rim 59 is positioned between magnet 74 and sensor 72 and shunts paths 80*a* and 80*b* from sensor 72** to provide a binary output of "1,0".

Figure 13:
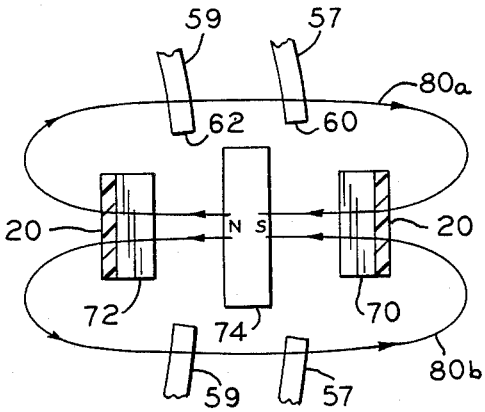
FIG. 13 is a section similar to FIG. 9 with notches between both sensors and the magnet.

In FIG. 13, a fourth rotative position of the shaft positions notches 60, 62 at magnet 74 to provide a magnetic field through both sensors 70, 72 and provide a binary output of "1,1".

Thus, by proper spacing of the notches 60, 62 in rims 57, 59 respectively, binary outputs of 1,1; 0,1; 1,0 and 0,0 are achieved in a relatively simple and durable construction to provide indications of corresponding shaft rotational positions. These outputs may be used to control engine functions, such as those disclosed and described in the aforementioned Nichols and Kozlowski, Jr. copending application.

It should be noted that although the preferred embodiment has been illustrated with reference to a four cylinder internal combustion engine the magnetic sensor of the present invention may also be implemented for use with other combinations of cylinders. For example, in a six cylinder engine, implementation would incorporate the positioning of three teeth or notches spaced about the movable member in a 120° angular spacing relationship. Similarly, an eight cylinder engine would require the implementation of four teeth or notches positioned on the movable member and spaced 90° apart. With such configurations, including the four cylinder configuration of the preferred embodiment, one radius of the movable member positions only one tooth or notch which functions as an "encoding" shunt to both reference the beginning of the firing sequence and to fire a selected pair of cylinders, and the other radius positions the remaining teeth or notches which function as "slave" shunts to fire the remaining pairs of cylinders. Those skilled in the art will recognize that this basic scheme of one encoding shunt and one or more other slave shunts may be implemented to operate an odd-cylinder engine or uneven firing angles.

Because the present invention generates and processes a variety of low voltage signals without a conventional distributor, the length of the high tension leads may be considerably shortened and the spark coils mounted relatively close to the spark plugs to minimize RFI. Also, the stationary mounting of the sensor apparatus and electronic processing of pulses in non-adjustable and discourages tampering with engine emission settings.

It should be noted that although the sensors shown in FIGS. 3 and 8 have been described and illustrated with reference to use in internal combustion engines and the like for sensing angular shaft positions, they may also be used to sense linear positions of a movable or reciprocating member relative to the sensor. One such linear application is the sensing of the vertical displacement of a vehicular body relative to the axle of the vehicle under various cargo loading conditions of the vehicle to adjust the vehicle suspension mechanism to compensate for the load.

Figure 15:
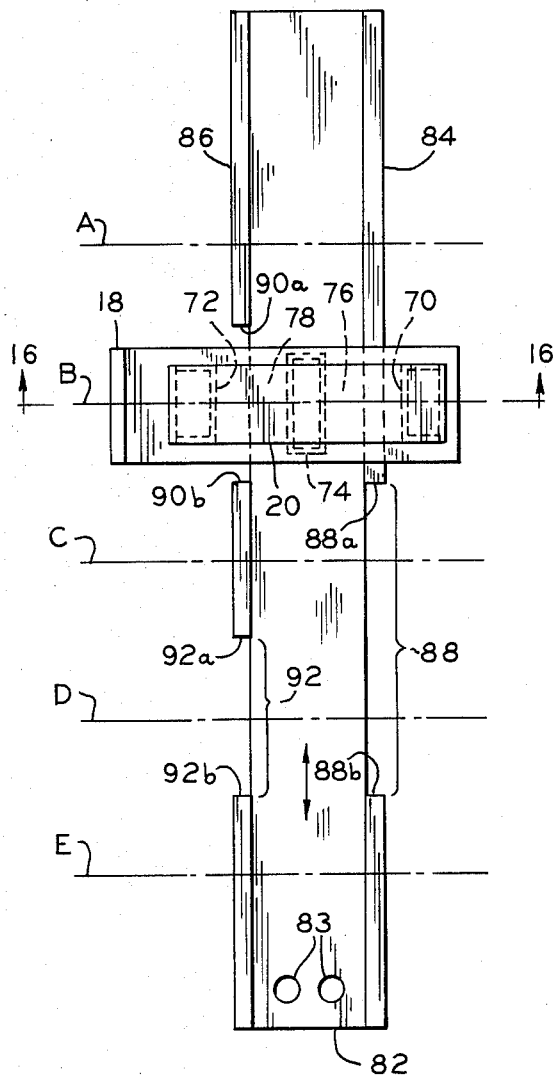
FIG. 15 is a side elevational view of an embodiment for detecting linear motion utilizing the channel of FIG. 14.
Figure 14:
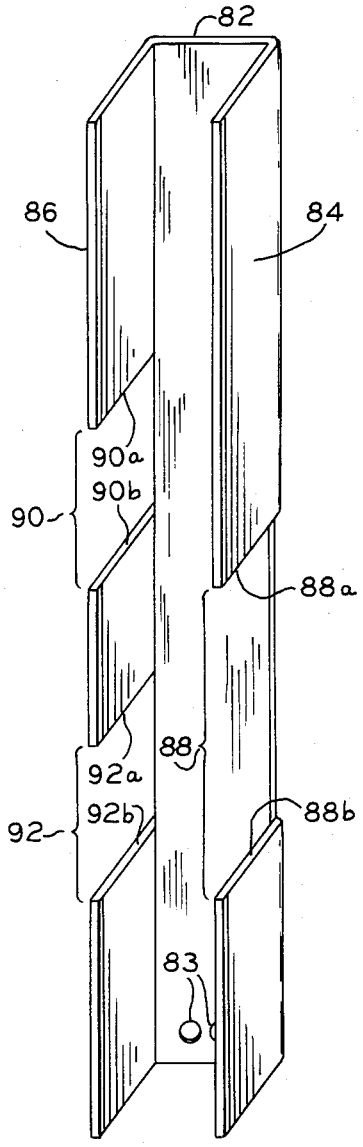
FIG. 14 is a perspective view of a channel having notched sides usable in an embodiment for detecting linear position and motion.
Figure 16:
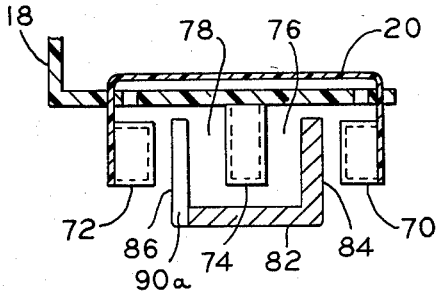
FIG. 16 is a view taken at 16—16 of FIG. 15.

Referring to FIGS. 14–16, apparatus for sensing relative linear motion between two parts will be described. As in the embodiments of FIGS. 8–13, magnet 74 is affixed to bracket 18 and Hall-effect sensors 70, 72 are supported by the arms of C-shaped support 20, defining regions 76, 78, respectively, with magnet 74. Support 20 is secured to bracket 18 which is mounted to, and movable with, one of the parts, not shown, but which may be one of a vehicle body and a wheel axle. The electrical connections to, and input and sensing circuitry for, sensors 70, 72 are not shown but may be as in the previous embodiment. The sensing circuitry would be modified to provide the desired outputs.

U-shaped in cross-section ferrous elongated channel 82 has sides 84, 86. Channel 82 is attached to, as with bolts 83, and movable with the other of the vehicle body and axle, and is positioned so that sides 84, 86 are movable in regions 76, 78, respectively, during relative movement between the body and axle. Side 84 has notch 88, defined by edges **88*a*, 88*b* and side 86 has notch 90, defined by edges 90*a*, 90*b*, and notch 92, defined by notches 92*a*, 92*b*. Thus, as channel 84 moves longitudinally relative sensors 70, 72**, output waveforms are generated to indicate relative linear positions therebetween.

Referring to FIG. 15, the outputs of sensors 70, 72 when positioned on line A would respectively be 0,0, since the magnetic flux in both regions 76, 78 are shunted; when positioned on line B, the outputs would respectively be 0,1, since region 76 is shunted and region 78 is not; when positioned on line C, the outputs would be 1,0; and when positioned on line D, the outputs would be 1,1. Thus, a two digit binary signal is provided to indicate relative linear position between two parts, such as a wheel and axle.

It is also possible to invert each of waveforms A, B by interchanging the notches and rim portions. Thus, by placing a rim portion where there is a notch, and placing a notch where there is a rim portion, the outputs would be inverted.

Thus, there may be seen that there has been provided a magnetic sensor apparatus useable in distributorless and contactless ignition systems as well as a linear position detecting apparatus to detect the relative position of a wheel and axle. Obviously, many modifications and variations of the invention are possible in light of the above teachings. For example, the magnetic sensor apparatus may be used for fuel metering applications in an internal combustion engine. As illustrated, the Hall-effect device may sense the position and speed of the rotating shaft as encoded by the placement of shunting teeth or notches thereon and then process such information to provide for fuel metering and distribution to respective cylinders of an engine in a predetermined sequence suitable for fuel injection purposes.

Various combinations of shunts and gaps may be provided to obtain desired outputs. Multiple digit binary codes, including two digit outputs, may be provided by utilizing multiple shunting members, such as notched rims or channel sides, and a corresponding number of magnets and sensor devices to sense the presence and absence of each notch. The magnets and sensors may conveniently be supported in a single package in substantial alignment along a line transverse to the notched rims or sides. For example, for a three digit binary signal, three rims or sides, with associated field producing means and sensor means, would be utilized. The invention may also be used in a variety of applications wherein it is desired to monitor or indicate generally the angular position of a rotating shaft within an apparatus or machine. It is therefore to be understood that within the scope of the appended claims the invention may be practiced otherwise than as specifically described.

What is claimed is:

1. Apparatus for use in a system having first and second parts that are movable relative one another comprising:

magnetic means having north and south poles for providing a magnetic flux path between said north and south poles;

sensor means comprising first and second sensors for sensing the magnetic flux in said path and for providing a signal corresponding to the sensed magnetic flux;

mounting means for mounting said magnetic means and said first and second sensors in substantially rectilinear alignment; said magnetic means being between said first and second sensors; said first and second sensors being intersected by a line through said north and south poles; said line being substantially parallel to said flux path at said north and south poles; said first sensor being linearly spaced on said line from said magnetic means south pole to form a first open region linearly defined along said line between said first sensor and said magnetic means south pole; said second sensor being linearly spaced on said line from said magnetic means north pole to form a second open region linearly defined along said line between said magnetic means north pole and said second sensor; whereby there is provided a predetermined flux concentration in said first and second open regions and whereby said first and second open regions provide dual information sensing regions.

2. The apparatus of claim 1 wherein said mounting means is affixed to the first part of the first and second parts; each of said open regions being dimensioned on said line to receive a respective magnetic field shunting member attached to the second part of the first and second parts so that as the first and second parts are moved relative one another each of the members correspondingly moves through its respective open region.

3. The apparatus of claim 1 wherein each of said first and sensor sensors is a Hall effect sensor.

4. The apparatus of claim 2 wherein the system is a distributorless ignition system and one of the first and second parts is a distributor rotatable shaft mounted for rotation about its axis relative the other of the parts, the other of the parts being an engine block.

5. The apparatus of claim 2 wherein the system is a linear position sensing system and one of the first and second parts is a linear member mounted for linear movement relative the other of said parts.

6. Apparatus for use in a system having first and second parts that are movable relative one another comprising:

magnetic means comprising first and second magnets each having a north and a south pole for providing a magnetic flux path between said north and south poles of each of said magnets;

sensor means for sensing the magnetic flux in said paths and for providing a signal corresponding to the sensed magnetic flux;

mounting means for mounting said sensor means and said first and second magnets in substantially rectilinear alignment; said sensor means being between said first and second magnets and being intersected by a line through said north and south poles of said first and second magnets; said line being substantially parallel to said first magnet flux path at said north and sourth poles of said first magnet; said first magnet being linearly spaced on said line from said sensor means to form a first open region linearly defined along said line between said first magnet and said sensor means; said second magnet being linearly spaced on said line from said sensor means to form a second open region linearly defined along said line between said second magnet and said sensor means; whereby there is provided a predetermined flux concentration in said first and second open regions and whereby said first and second open regions provide dual information sensing regions.

7. The apparatus of claim 6 wherein said sensor means comprises a Hall effect sensor.

8. The apparatus of claim 6 wherein said mounting means is for mounting said magnets so that like poles of said magnets are facing said sensor means.

9. The apparatus of claim 6 wherein said mounting means is affixed to the first part of the first and second parts; each of said first and second open regions being dimensioned on said line to receive a respective magnetic field shunting member attached to the second part of the first and second parts so that as the first and second parts are moved relative one another each of the members correspondingly moves through its respective open region.

10. The apparatus of claim 3 wherein said north and south poles of said first and second magnets are in rectilinear alignment.

11. The apparatus of claim 9 wherein the system is a distributorless ignition system and one of the first and second parts is a distributor rotatable shaft mounted for rotation about its axis relative the other of the parts, the other of the parts being an engine block.

* * * * *

UNITED STATES PATENT AND TRADEMARK OFFICE

CERTIFICATE OF CORRECTION

PATENT NO. : 4,508,092

DATED : April 2, 1985

INVENTOR(S) : Ronald J. Kiess and Gary R. Nichols

It is certified that error appears in the above—identified patent and that said Letters Patent is hereby corrected as shown below:

Col. 4, l. 3 for "sufaces" read --surfaces--;
Col. 8, l. 54 for "in" read --is--;
Col. 11, l. 6 for "sourth" read --south--;
Col. 12, l. 13 for "3" read --8--.

Signed and Sealed this

*Twenty-seventh* Day of *August 1985*

[SEAL]

*Attest:*

DONALD J. QUIGG

*Attesting Officer* *Acting Commissioner of Patents and Trademarks*